United States Patent [19]

Snyder et al.

[11] 4,255,008

[45] Mar. 10, 1981

[54] ELECTRICAL CONNECTOR ASSEMBLY HAVING ANTI-DECOUPLING DEVICE

[75] Inventors: Gene L. Snyder; David W. MacAvoy, both of Bainbridge, N.Y.

[73] Assignee: The Bendix Corporation, Southfield, Mich.

[21] Appl. No.: 71,463

[22] Filed: Aug. 31, 1979

[51] Int. Cl.[3] ..... H01R 13/639

[52] U.S. Cl. ..... 339/89 M; 411/190

[58] Field of Search ..... 339/89 R–91 B; 285/81, 82, 87, 88; 157/25 R

[56] References Cited

U.S. PATENT DOCUMENTS

| | | | |
|---|---|---|---|
| 3,390,900 | 7/1968 | McCormick et al. | 285/81 |
| 4,109,990 | 8/1978 | Waldron et al. | 339/89 M |

*Primary Examiner*—Eugene F. Desmond

*Attorney, Agent, or Firm*—William G. Kratz, Jr.; Raymond J. Eifler; Charles D. Lacina

[57] ABSTRACT

An electrical connector assembly that is readily coupled or uncoupled is provided with means for retarding premature uncoupling thereof. The connector assembly comprises a first shell 100 having a flange 140 thereabout and bosses 111 on the periphery thereof adjacent the flange, and a coupling nut 300 that has stop members 311 on the inner wall thereof. A spring 500 is situate between the flange 140 of the first shell 100 and the end wall 305 of the coupling nut, with the stop members preventing rotational movement of the spring 500 relative to the coupling nut 300, while the bosses 111 retard movement of the spring 500 relative to the first shell 100.

13 Claims, 5 Drawing Figures

ELECTRICAL CONNECTOR ASSEMBLY HAVING ANTI-DECOUPLING DEVICE

BACKGROUND OF THE INVENTION

The present invention relates to an electrical connector assembly having a coupling nut for use in coupling and decoupling of the electrical connectors. More specifically, the invention relates to a means to prevent premature decoupling of connectors by loosening of the coupling nut due to vibrational or other forces that would tend to loosen the coupling nut from its connection to the shells.

The electrical connector assembly described herein is an improvement over the mechanism described in U.S. Pat. No. 4,109,990, assigned to the assignee of the present invention, the contents of said patent being incorporated by reference herein. In U.S. Pat. No. 4,109,990 an electrical connector assembly is disclosed which includes a leaf spring that is mounted on the coupling nut and coacting ratchet teeth carried on a shoulder on the outside of the connector. Use of such springs and coacting ratchet teeth, however, require that the coacting parts have close tolerances to provide efficient and sure contact therebetween. Wearing of the teeth or the spring element also can be troublesome following repeated coupling and uncoupling of the connectors. Generally, a plurality of the leaf springs are provided which results in additional cost in fabrication of the leaf springs and fixation of the leaf springs about the coupling nut.

The present device provides an efficient anti-coupling device that has fewer parts and is easily manufactured using a minimum of manufacturing steps.

SUMMARY OF THE INVENTION

The present invention relates to a quickly coupled and uncoupled electrical connector assembly that provides resistance to premature uncoupling.

The present invention is an electrical connector assembly characterized by a coupling nut 300 having stop members 311, and a first shell 100 having a flange 140 thereon and at least one boss 111 thereon between the flange 140 and the end wall 305 of the coupling nut 300, with a helical spring 500 situate between the coupling nut 300 and the first shell 100, and in frictional contact with the bosses 111. The stop members 311 extend between adjacent coils of the helical spring 500 so as to hold the coupling nut 300 and spring 500 in nonrotational relationship, while contact of the spring 500 with the bosses 111 and distension of the spring, will provide frictional engagement between the spring and the first shell to retard rotational movement between the first shell 100, the spring 500, and the coupling nut 300.

DETAILED DESCRIPTION

Figure 1:
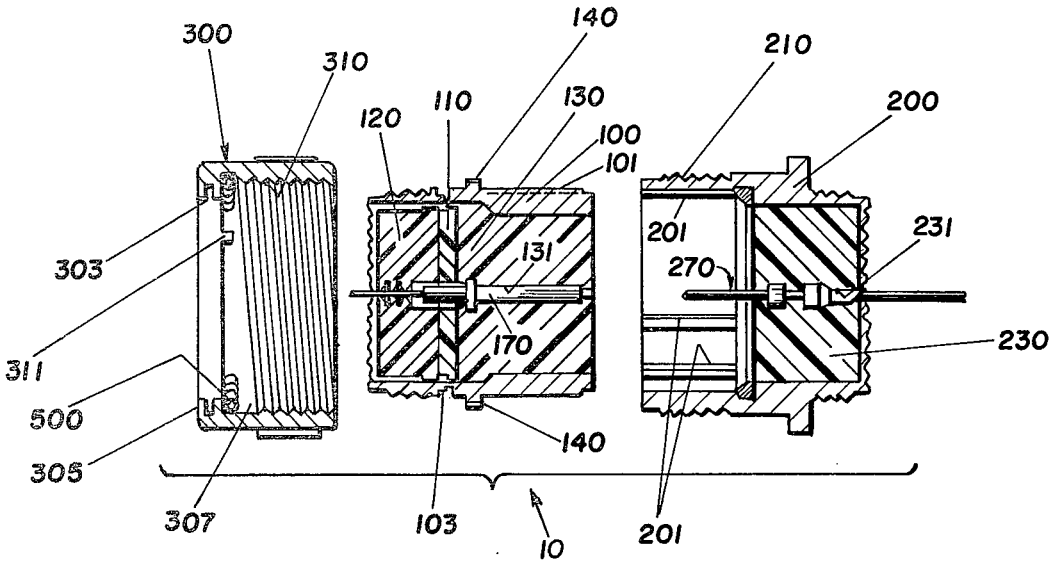
FIG. 1 is a cut-away view of the three main portions of an electrical connector assembly.
Figure 2:
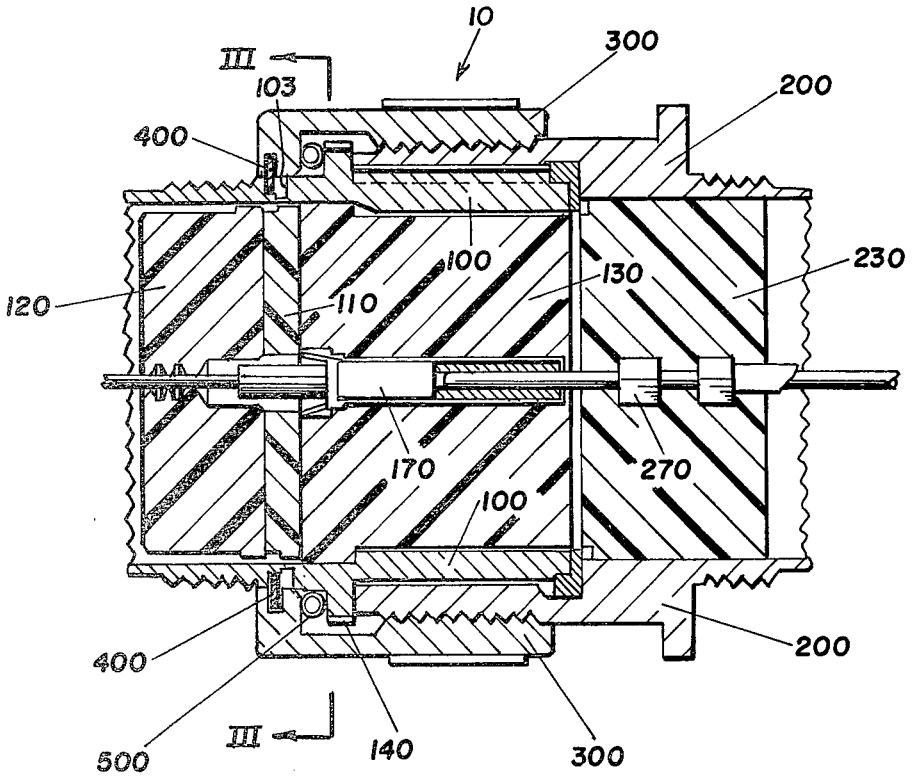
FIG. 2 is a cut-away view of an electrical connector assembly after connection of the main portions.

Referring now to the drawings, an electrical connector assembly 10 according to the present invention is illustrated, which includes a first shell 100, a second shell 200 and a coupling nut 300 that is mounted on the first shell 100 for connecting the first shell 100 and the second shell 200 in mating relationship. Typical components of the first shell 100 include one or more female type (socket) electrical contacts 170 retained within the shell 100 by inserts 110, 120 and 130. The outer surface of the first shell 100 includes one or more keys 101 for orienting the first shell 100 relative to the second shell 200. The contacts 170 are mounted within passages 131 through the inserts. The shell 100 includes a flange 140 which extends around the outer periphery thereof.

Typical components of the second shell 200 include one or more axially extending recesses or keyways 201 for receiving the respective keys 101 on the first shell 100. The second shell includes one or more male type (pin) electrical contacts 270 that mate with the socket type contacts 170 of the first shell. These contacts 270 are retained in the second shell 200 by one or more inserts 230. The inserts 230 include a passage 231 along with means for retaining the contacts within the passage. The shell 200 includes a forward external thread 210.

The coupling nut 300 is mounted over the rear section of the first shell 100, with internal threads 310 on the coupling nut adapted to mate with the external threads 210 on the second shell to bring the first and second shells together with the contacts mated. The coupling nut also has a groove 303 about the inner periphery of the end wall 305 of the coupling nut 300, with a C-shaped snap sealing ring 400 adapted to be snapped into the stepped groove 103 of the first shell 100 and upon connection of the coupling nut 300 and the first shell 100, the snap ring will seat within groove 303 of the coupling nut 300 to limit the axial movement of the assembled coupling nut 300 and first shell 100.

The coupling nut has on the interior thereof, adjacent the end wall 305, inwardly extending stop members 311 which stop members comprise tab-like projections. The stop members 311 preferably depend from an undercut portion 307 of the interior of the coupling nut 300. The stop members 311 could alternatively depend from the end wall 305 inwardly therefrom.

In order to retard the rotational movement of the coupling nut 300 relative to the first shell 100, a plurality of bosses 111 (FIG. 3) are provided on the outer surface of the shell adjacent the flange 140, and a helical spring 500 is provided which fits about the first shell 100 in contact with, and distended at portions thereof by, said bosses 111.

Figure 3:
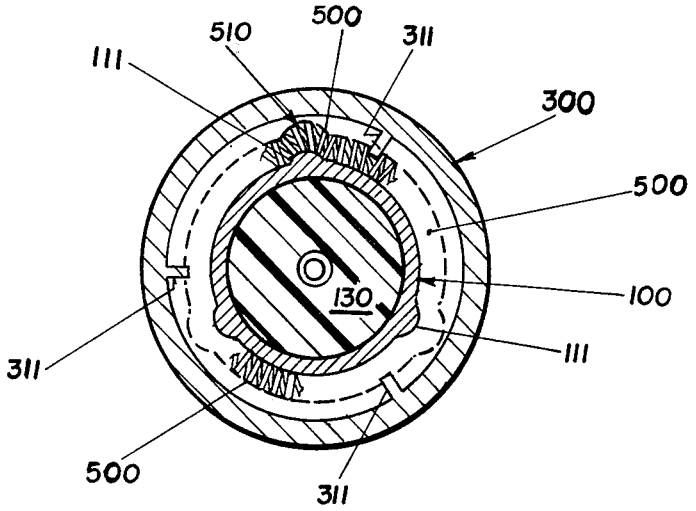
FIG. 3 is a cross-sectional view of the coupling nut and electrical connector taken along lines III—III of FIG. 2.
Figure 4:
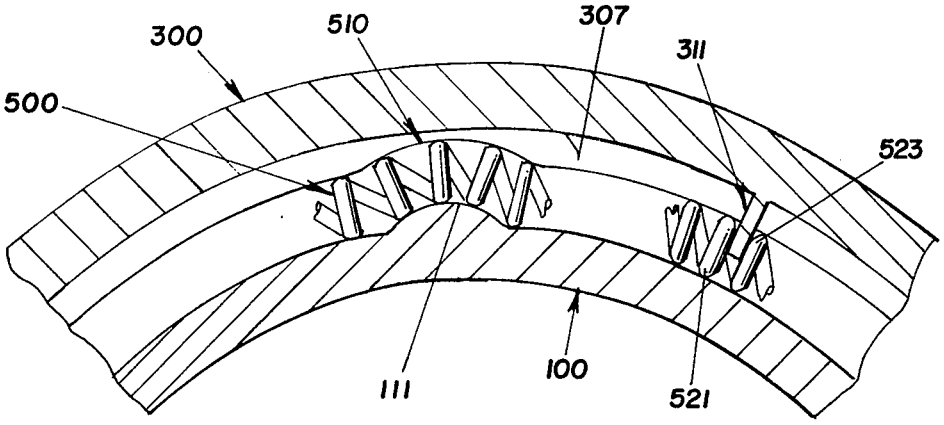
FIG. 4 is an enlarged fragmentary view showing the spring in cooperation with the coupling nut and first shell, as in FIG. 3.
Figure 5:
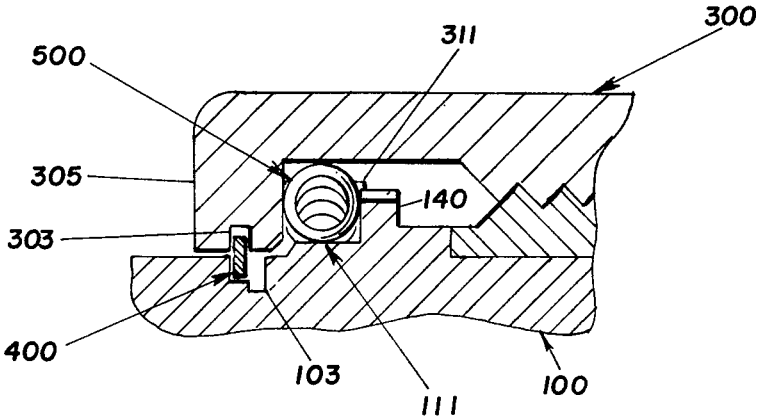
FIG. 5 is an enlarged cross-sectional view of the upper portion of FIG. 2, showing the anti-decoupling device of the present invention.

As illustrated in FIG. 3, the spring 500 is tightly fitted about the first shell 100 with portions thereof, such as indicated at 510, being distended by the bosses 111 on the first shell. The stop means, such as tabs 311, extend inwardly from the coupling nut 300 and are of a length and width such as to protrude between individual adjacent coils 521 and 523 of the spring (FIG. 4). With the stop members 311 projecting into the spring 500, the spring will be held in nonrotational relationship to the coupling nut 300, although the spring 500 wrapped about the first shell 100 is still in spaced relation to the inner wall of the coupling nut 300. The spring 500, however, being distended at portions, such as at 510, by the bosses 111 on the first shell 100, will provide sufficient frictional contact between the spring 500 and first shell 100, and the stop members 311 in contact with the spring 500 will, in combination, retard the rotation of the coupling nut 300 and spring 500, with respect to the first shell 100.

The amount of resistance to rotation of the coupling nut relative to the first shell can be varied, depending on the desired degree of resistance, by changing the helix pitch of the spring 500, the wire diameter of the spring 500, or other means, in furtherance of the invention.

In bringing the various components together to form the connector assembly, the spring 500, which has a circular shape that is comparable to the periphery of the first shell 100, is inserted into the coupling nut 300, within the undercut portion 307, with the stop members 311 inserted between adjacent coils of the spring 500. The first shell 100 is then placed in mating relationship with the coupling nut 300 and the spring 500 will be trapped between the end wall 305 of the coupling nut 300 and the flange 140 of the first shell 100. The bosses 111 will distend portions of the spring 500 so as to form distended portions 510 and frictionally engage the spring 500. The coupling nut 300 is then threaded onto the threads 210 of the second shell 200 by means of threads 310 to complete the electrical connector assembly 10.

In the positioning of the stop members 311, a plurality of said stop members is preferred which are equally spaced about the periphery of the inner wall of the coupling nut 300. The bosses 111 are also preferably equally spaced about the periphery of the shell 100. Three or more such stop members 311 and such bosses 111 are preferred. The stop members 311 and bosses 111 are preferably offset relative to each other upon complete assembly of the connector, although clearance is provided between the stop members and bosses so as to enable passage of the stop members thereover during assembly, with the spring 500 forcibly movable about the first shell due to force exerted through turning of the coupling nut 300 and engagement of the spring 500 by the stop members 311.

An advantage of the use of the present construction, wherein a helical spring is used, resides in the ability to lock the connectors together regardless of the coupling position of the connectors. The absence of specifically oriented coacting locks or other mechanisms on the coupling nut and the first shell, the 360° coverage of the spring angle of the helix and total inward radial force for 360° assure a constant and consistent locking relationship between the coupling nut and the first shell. In addition, the strict tolerance requirements that must be met between the mating components that affect final position of other anti-decoupling devices are eliminated by the present construction, where a spring is present completely about the first shell.

What is claimed is:

1. In an electrical connector assembly comprising:

a first shell having an insert with a plurality of axial passages;

a second shell having an insert with a plurality of axial passages, said second shell having thread means on a portion of the outside of said second shell;

a plurality of pin-type electrical contacts, each mounted in a respective axial passage of one of said inserts;

a plurality of socket-type electrical contacts, each mounted in a respective axial passage of the other of said inserts, said socket-type electrical contacts arranged in the other insert in the same manner as the pin-type electrical contacts are arranged in the first insert and matable with said pin-type electrical contacts;

a coupling nut for selectively connecting and maintaining said first and second shells together and holding said pin-type and socket-type electrical contacts together in a mated position, said coupling nut having an end wall, mounted for rotational movement on said first shell with thread means connectable with the thread means on the second shell for connecting the first and second shells together with the pin-type and socket-type electrical contacts held in mated relationship; and means for constantly and consistently retarding the rotational movement of the coupling nut relative to the first and second shells regardless of the position of the coupling nut and direction of rotation thereof relative to said shells, the improvement wherein said retarding means comprises:

at least one stop member extending inwardly from the coupling nut;

a flange formed about the first shell;

at least one boss on the first shell intermediate said flange and said end wall of the coupling nut; and a helical spring wrapped about the first shell intermediate said flange and said end wall, said stop member protruding between and abutting individual ajacent coils of said helical spring to secure said spring in nonrotational relationship to the coupling nut and said boss distending portions of said spring wrapped thereover to provide sufficient frictional contact between the spring and the first shell to retard rotational movement of said first shell relative to said coupling nut.

2. An electrical connector assembly as defined in claim 1 wherein a plurality of said stop members are provided on said coupling nut.

3. An electrical connector assembly as defined in claim 2 wherein said plurality of stop members are equally spaced about the inner wall of said coupling nut.

4. An electrical connector assembly as defined in claim 1 wherein a plurality of said bosses are provided on said first shell.

5. An electrical connector assembly as defined in claim 4 wherein said plurality of bosses are equally spaced about the first shell.

6. An electrical connector assembly as defined in claim 1 wherein a plurality of said stop members are provided on the coupling nut, and a plurality of bosses are provided on the first shell, with each said boss being off-set relative to each said stop member when the electrical connector assembly is in assembled position.

7. An electrical connector assembly as defined in claim 1 wherein said coupling nut includes an interior wall having an undercut portion adjacent the end wall thereof and wherein said stop member depends from the undercut portion in said coupling nut.

8. An electrical connector assembly as defined in claim 1 wherein said coupling nut includes an interior wall having an undercut portion adjacent the end wall thereof and wherein said stop member depends from the end wall of said coupling nut.

9. In an electrical connector assembly comprising:

a first shell having an insert with a plurality of axial passages;

a second shell having an insert with a plurality of axial passages, said second shell having thread means on a portion of the outside of said second shell;

a plurality of pin-type electrical contacts, each mounted in a respective axial passage of one of said inserts;

a plurality of socket-type electrical contacts, each mounted in a respective axial passage of the other of said inserts, said socket-type electrical contacts arranged in the other insert in the same manner as the pin-type electrical contacts are arranged in the first insert and matable with said pin-type electrical contacts;

a coupling nut for selectively connecting and maintaining said first and second shells together in a mated position, said coupling nut having an end wall, mounted for rotational movement on said first shell with thread means connectable with the thread means on the second shell for connecting the first and second shells together with the pin-type and socket-type electrical contacts held in mated relationship; and means for constantly and consistently retarding the rotational movement of the coupling nut relative to the first and second shells regardless of the position of the coupling nut and direction of rotation thereof relative to said shells, the improvement wherein said retarding means comprises:

a plurality of stop members extending inwardly from the coupling nut;

a flange formed about the first shell;

a plurality of bosses on the first shell intermediate said flange and said end wall of the coupling nut; and a helical spring wrapped about the first shell intermediate said flange and said end wall, each of said stop members protruding between individual and adjacent coils of said helical spring to secure said spring in nonrotational relationship to the coupling nut and each of said bosses distending portions of said spring wrapped thereover to provide sufficient frictional contact between the spring and the first shell to retard rotational movement of said first shell relative to said coupling nut.

10. An electrical connector assembly as defined in claim 9 wherein each of said plurality of bosses is offset relative to said stop members when the electrical connector assembly is in assembled position.

11. For an electrical connector assembly having first and second connector members movable relative to each other along an axis into and out of mated position and secured together in the mated position by a coupling nut rotatably mounted on one of the shells the coupling nut having a radial end wall having an interior surface, means for constantly and consistently retarding rotational movement of the coupling nut with respect to the shells regardless of the position of the coupling nut and direction of rotation thereof relative to said shells, said retarding means comprising said first shell having an outer wall disposed in faced relation to the interior surface of the coupling nut and defining an annular space therebetween;

a helical spring having a plurality of substantially uniform coils disposed in the annular space and fitted about the outer wall of the shell;

a plurality of tab-like projections, each of said projections extending inwardly from the coupling nut with each being adapted to protrude inwardly between adjacent coils of the spring;

a plurality of bosses disposed on the outer wall of the first shell; and an annular undercut circumposing the outer wall of the first shell, said undercut including a plurality of radial outward detents aligned with the bosses, whereby the projections between individual coil pairs prevent rotation of the spring relative to the coupling nut and the bosses act to distend the spring and provide frictional engagement between the spring and the first shell.

12. An electrical connector assembly as recited in claim 11 wherein said tab-like projections extend axially inward from the end wall of the coupling nut to engage the spring coils.

13. An electrical connector assembly as recited in claim 11 wherein said tab-like projections extend radially inward from the interior surface of the coupling nut to engage the spring coils.

* * * * *